US007000289B2

(12) United States Patent
Cedrone

(10) Patent No.: US 7,000,289 B2
(45) Date of Patent: Feb. 21, 2006

(54) GRAVITY HINGE

(75) Inventor: Daniel Pompel Cedrone, Huntersville, NC (US)

(73) Assignee: Poly-Tech Industrial, LLC, Huntersville, NC (US)

( * ) Notice: Subject to any disclaimer, the term of this patent is extended or adjusted under 35 U.S.C. 154(b) by 3 days.

(21) Appl. No.: 09/780,306

(22) Filed: Feb. 9, 2001

(65) Prior Publication Data

US 2002/0116788 A1 Aug. 29, 2002

(51) Int. Cl.
*E05F 1/02* (2006.01)
*E05D 11/08* (2006.01)

(52) U.S. Cl. ..... 16/309; 16/316; 16/273

(58) Field of Classification Search ..... 16/316, 16/273, 312, 309, 318
See application file for complete search history.

(56) References Cited

U.S. PATENT DOCUMENTS

| | | | | | |
|---|---|---|---|---|---|
| 170,314 | A | * | 11/1875 | Toedt | 16/318 |
| 424,088 | A | * | 3/1890 | Booraem | |
| 898,005 | A | * | 9/1908 | Rodler | |
| 1,027,716 | A | * | 5/1912 | Fletcher | |
| 1,072,364 | A | * | 9/1913 | Roberts | |
| 1,076,689 | A | * | 10/1913 | McKinney | |
| 1,818,182 | A | * | 8/1931 | Woernle | |
| 2,860,370 | A | * | 11/1958 | Honnay | |
| 3,083,402 | A | * | 4/1963 | Foltz | |
| 3,398,487 | A | * | 8/1968 | Matyas | |
| 3,545,032 | A | | 12/1970 | Dielman | |
| 3,725,973 | A | | 4/1973 | Gwozdz | |
| 3,733,650 | A | | 5/1973 | Douglas | |
| 3,862,470 | A | * | 1/1975 | Swank | 16/318 |
| 3,921,225 | A | * | 11/1975 | Suska | |
| 4,215,449 | A | * | 8/1980 | Loikitz | |
| 4,630,332 | A | | 12/1986 | Bisbing | |
| 4,631,777 | A | | 12/1986 | Takimoto | |
| 4,697,306 | A | * | 10/1987 | Rhodes | |
| 4,720,198 | A | | 1/1988 | DeBruyn | |
| 4,734,013 | A | | 3/1988 | Valavaara | |
| 4,864,691 | A | * | 9/1989 | Gidseg et al. | |
| 4,964,193 | A | | 10/1990 | Rommelfaenger et al. | |
| 4,991,259 | A | | 2/1991 | Finkelstein et al. | |
| 5,652,694 | A | * | 7/1997 | Martin | |
| 5,706,556 | A | * | 1/1998 | Kluting | |
| 5,881,431 | A | * | 3/1999 | Pieper, II et al. | |

FOREIGN PATENT DOCUMENTS

| | | | |
|---|---|---|---|
| DE | 3303801 A1 | * | 8/1984 |
| EP | 0136211 | * | 4/1985 |
| JP | 5-86767 | * | 4/1993 |

* cited by examiner

*Primary Examiner*—Alison K. Pickard
(74) *Attorney, Agent, or Firm*—Summa, Allan & Additon, P.A.

(57) ABSTRACT

A gravity hinge is disclosed that is simple to manufacture and avoids limitations found in known gravity hinges. The hinge includes two cylindrical knuckles joined by a spindle and separated by a polymer bushing. The junction of the knuckles and the bushing is at an angle oblique to the vertical axis of the knuckles and spindle. The oblique angle causes the upper knuckle to rotate upward upon the application of a rotational force thereby storing potential energy. Upon the release of the rotational force the upper knuckle falls or (rotates) back into place thereby returning the hinge to its natural, closed position.

13 Claims, 3 Drawing Sheets

GRAVITY HINGE

FIELD OF THE INVENTION

The invention relates to the field of closures; specifically hinge closures. In particular the invention relates to safety structures that incorporate hinges that operate primarily under the influence of gravity to secure closure of safety fences and gates.

BACKGROUND OF THE INVENTION

The present invention relates to safety barriers, and in particular relates to safety fences and gates in which opened gates return automatically to a closed position. One particular use for hinges along this line is pedestrian traffic control in industrial work areas. For example, Federal regulatory authorities (e.g., OSHA and EPA) require extensive systems to control the path and flow of workers in industrial plants. Hinged gates and doors are often used to restrict movement in areas deemed dangerous or to seal off areas containing harmful materials. Typically these regulations are implemented by installing extensive railing systems painted in fluorescent colors, usually bright yellow.

A common feature of these systems are self-closing gates and doors. Currently, spring loaded gates which automatically close via the tension in the spring are most commonly used. Other types of gates that are known and could be used are gravity gates that close automatically via the action of gravity.

Gravity gates typically employ a cylindrical hinge consisting of at least two parts: a lower portion and an upper portion that rotates about an oblique junction upon the application of a rotational force. As the upper portion rotates, the two portions separate due to the oblique junction. The upper portion "rises" thereby storing potential energy which will cause the upper portion to "fall" or rotate back to a neutral position when the rotational force is terminated. Examples of such a gate are shown in U.S. Pat. No. 4,631,777 to Takimoto, U.S. Pat. No. 3,733,650 to Douglas and U.S. Pat. No. 4,991,259 to Finkelstein et al.

One problem associated with known gravity gates is common to all devices that employ moving parts: friction. In many instances the rotating portions of the hinges are in direct contact with one another which causes friction. If the portions are made of metal, as they often are, the friction could lead to premature failure of the hinge absent some form of external lubrication. External lubrication, most often in the form of grease, is messy and transitory thereby leading to frequent maintenance.

More recent designs of gravity gates incorporate polymers to reduce the weight of the hinge and friction. The Douglas, Takimoto and Finkelstein patents cited above discuss implementing polymers in the design of gravity gates. These patents discuss hinges that use polymer cams to translate rotational energy to potential energy. Although polymer cams reduce friction, polymer cams are far more susceptible to torsional failures than metallic cams. Furthermore, the devices of these patents utilize multiple polymeric parts which increases the likelihood of torsional failure. When these weaknesses are combined with the difficulties relating to machining and molding such intricate polymer parts, the impracticality of these hinges is readily apparent.

Another weakness of known hinge and gate designs is the free conduction of electricity. Many hinges and gates employ metal on metal contact which leads to the conduction of electricity. Such conduction can be fatal. For example, a hot wire falling on a metal railing could electrocute someone passing through a swing gate attached to the railing.

OBJECT AND SUMMARY OF THE INVENTION

Therefore, an object of the present invention is to provide a hinge that automatically closes upon the application of gravity.

A further object of the invention is to provide a gravity hinge that is efficiently designed and easy to maintain.

A still further object of the invention is to provide a gravity hinge that eliminates the need for periodic lubrication of the hinge joint.

A still further object of the invention is to provide a gravity hinge, gate and fencing system that reduces or eliminates electrical conduction between the fence portion and the gate portion of the system.

The gravity hinge according to the invention meets these and other objects. The gravity hinge comprises an upper cylindrical knuckle having a first terminating surface and an opposing second terminating surface. The second terminating surface is oblique to the axis of the upper knuckle. The gravity hinge also comprises a lower cylindrical knuckle having a first terminating surface oblique to the axis of the lower knuckle. Preferably the oblique angle of the lower knuckle first terminating surface is approximately the same as the second surface of the upper knuckle. The lower knuckle also has an opposing second terminating surface.

A spindle, which is received by at least one of the knuckles, establishes rotating communication between the upper and lower knuckles. The upper and lower knuckles are situated such that the second terminating surface of the upper knuckle is opposed to the first terminating surface of the lower knuckle.

A bushing surrounds the spindle and separates the upper and lower knuckles. The bushing has a lower coefficient of friction with respect to the respective oblique surfaces of the upper and lower knuckles than the respective surfaces have for each other.

DETAILED DESCRIPTION

Figure 1:
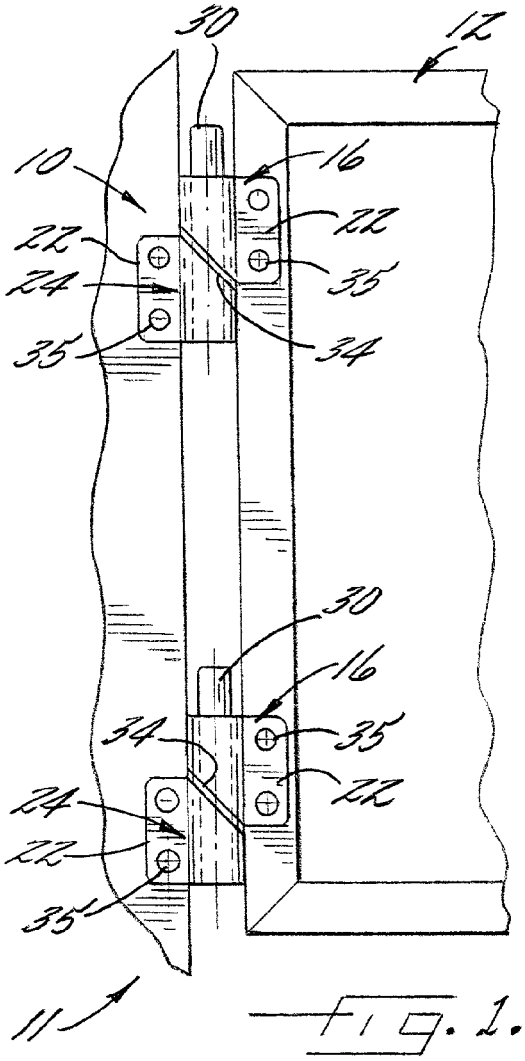
FIG. 1 is a side view of one embodiment of the hinge according to the invention.

The invention provides a gravity hinge for use with a gate, door or other hinged closure. As used herein, the term "hinge" has its usual definition; e.g., "a jointed or flexible device on which a door, lid or other swinging part turns." Merriam-Websters' Collegiate Dictionary (online edition, cited as of Jan. 9, 2001). Referring now to FIG. 1, there is shown a hinge 10 in accordance with the invention. For ease of discussion and presentation to the reader, the hinge 10 is shown in conjunction with a gate or door 12 and support post 14 such as would be commonly found in the practice of the invention. This particular setting, however, should not be interpreted as limiting in any way the scope of the invention.

Figure 2:
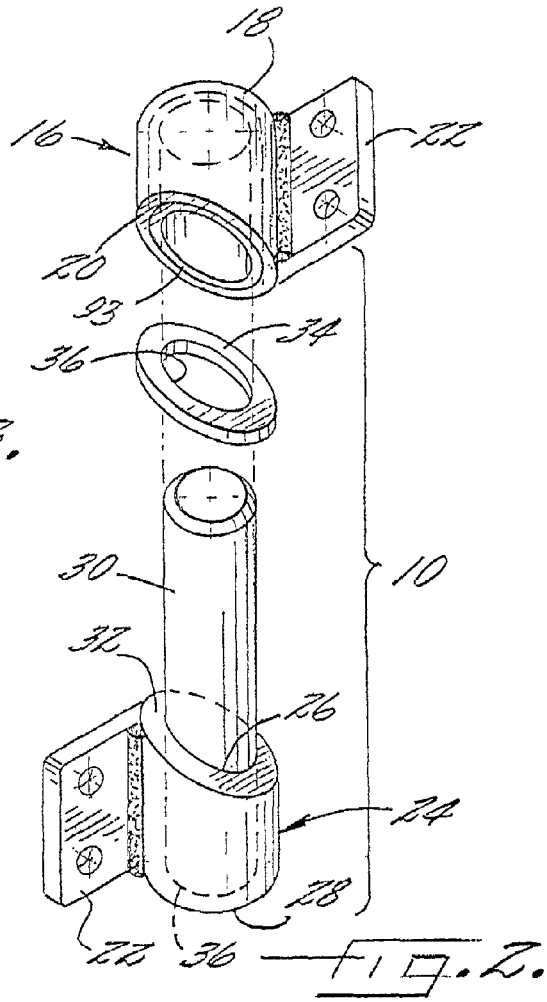
FIG. 2 is an exploded view of one embodiment of the hinge according to the invention.

Referring now to FIG. 2, in a preferred embodiment the hinge 10 according to the invention comprises an upper tubular cylindrical knuckle 16. As used herein relational terms such as upper and lower are used for explanatory purposes and as an aid to the reader's interpretation of the drawings. Such terms should not be read or interpreted as any type of limitation on the scope of the invention. The upper tubular cylindrical knuckle 16 is defined by a first terminating surface 18 that is preferably perpendicular to the axis of the upper tubular cylindrical knuckle 16. The upper tubular cylindrical knuckle 16 is also defined by a second terminating surface 20 that is separated from and opposed to the first terminating surface 18. The second terminating surface 20 is oblique to the axis of the upper tubular cylindrical knuckle 16. As shown in FIG. 2, the first and second terminating surfaces 18, 20 give the upper knuckle 16 the general appearance of a truncated right circular cylinder. Preferably, a flange 22 is attached to the outer surface of the upper tubular cylindrical knuckle 16 to secure the knuckle to the gate, door or closure used in conjunction with the hinge 10. The flange 22 may be manufactured integral with the upper tubular cylindrical knuckle 16 or manufactured separate from the upper tubular cylindrical knuckle 16.

The upper tubular cylindrical knuckle 16 is preferably made of metal but may be made of any suitable material (i.e., ceramic, polymers) provided the material possesses the requisite physical properties required for the particular use. For example, the hinge may be made electrically or thermally insulating by choosing an insulating ceramic or polymer. Suitable polymers include but are not limited to neat or "unfilled" polytetrafluoroethyelene (PTFE), polyetheretherketone (PEEK) and ultra-high molecular weight polyethylene (UHMW). Similarly, the hinge may be made electrically or thermally conductive by choosing an appropriate metal or modified polymer such as "filled" PTFE, PEEK or UHMW. The term polymer as used herein includes, but is not limited to, polymers and composites comprising polymers including fiberglass.

Theoretically, the angle of the oblique second terminating surface 20 may be any angle between 0° and 90°. As a practical matter, however, angles between about 30° and 50° are preferred, with angles of about 45° being most preferred.

The hinge 10 also comprises a lower cylindrical knuckle 24. The lower cylindrical knuckle 24 has a first terminating surface 26 that is oblique to the axis of the lower knuckle 24. Preferably the angle of the oblique first terminating surface 26 is approximately equal to the angle of the second terminating surface 20 of the upper tubular cylindrical knuckle 16. The lower cylindrical knuckle 24 also has a second terminating surface 28 separate from and opposing the first terminating surface 26. Preferably, the second terminating surface 28 is perpendicular to the first terminating surface 26, thus forming a structure resembling a truncated right circular cylinder. Just as with the upper tubular cylindrical knuckle 16, the lower cylindrical knuckle 24 may be made of metal or any other suitable manufacturing material (i.e., ceramic or polymer).

A spindle 30, which is received by at least one of the two knuckles, establishes rotating communication between the upper and lower knuckles. Stated alternatively, the spindle 30 rotatably engages the upper and lower knuckles 16, 24 such that the oblique terminating surfaces 20, 26 are proximate to each other.

In the embodiment shown in FIG. 2, the spindle 30 extends from the first terminating surface 26 of the lower cylindrical knuckle 24. The spindle 30 should have a diameter that is smaller than the diameter of the lower cylindrical knuckle 24 thereby creating an oblique ledge 32 corresponding to the outer perimeter portion of the oblique terminating surface 26. The spindle 30 may be integral to the lower cylindrical knuckle 24 as shown in FIG. 2. For example, the spindle 30 could be a machined extension of the lower knuckle 24 or physically attached to the lower knuckle 24 (e.g., welded). Alternatively, the spindle 30 may be separate from the lower cylindrical knuckle 24. In this latter embodiment, the lower cylindrical knuckle 24 must possess a recess for receiving a portion of the spindle 30. Such a recess is represented by the dotted lines 36 in the lower knuckle 24 shown in FIG. 2.

In preferred embodiments, the spindle 30 and the lower cylindrical knuckle 24 are integral and the length of the spindle 30 extending from the lower knuckle 24 is greater than the maximum length of the upper cylindrical knuckle 16. Just as with the knuckles, the spindle 30 may be made of metal or any other suitable manufacturing material (i.e., ceramic or polymer).

A flange 22 attached to the outer surface of the lower cylindrical knuckle 24 secures the knuckle to the post or static structure utilized in conjunction with the hinge 10. The flange 22 may be manufactured integral with the lower cylindrical knuckle 24 or manufactured separate from the knuckle.

Figure 3:
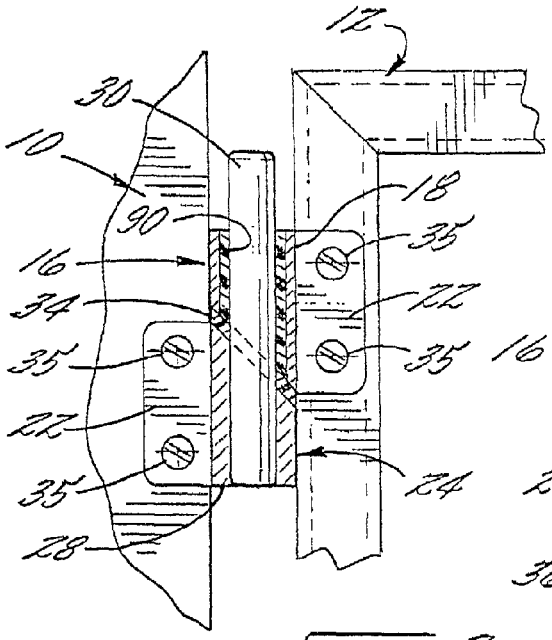
FIG. 3 is a partial cross-section of one embodiment of the hinge according to the invention.

As shown in FIGS. 2 and 3, one embodiment of a gravity hinge 10 according to the invention is formed when the upper tubular cylindrical knuckle 16 receives in a close mating relationship the spindle 30 extending from the lower knuckle 24. The upper knuckle second terminating surface 20 thus comes into close contact with the lower knuckle first terminating surface 26, specifically the oblique ledge 32 of the lower knuckle first terminating surface 26. If the knuckles are made from a non-polymeric substance, such as metal, significant friction will typically develop at the interface between the knuckles. Thus, a complete gravity hinge 10 according to the invention also comprises a self-lubricating friction reducer 34 that separates the upper knuckle second terminating surface 20 and the lower knuckle first terminating surface 26. In a preferred embodiment, the self-lubrication friction reducer 34 is a bushing possessing an opening 36 that allows the bushing to slide down and surround the base of the spindle 30 and rest upon the oblique ledge 32 of the lower cylindrical knuckle 24.

The self-lubricating friction reducer 34 is formed of a material possessing a coefficient of friction with respect to the oblique surfaces of the upper and lower knuckles (20, 32) that is lower than the coefficient of friction between the two oblique surfaces (20, 32). Accordingly, the self-lubricating friction reducer 34 is not limited to any particular material. For example, in certain circumstances, it could be formed of metal (i.e., brass) or ceramic provided its coefficient of friction with respect to the oblique surfaces is lower than the coefficient of friction between the two oblique surfaces. As with the knuckles, the exact material of construction for the bushing will depend on individual circumstances. Suitable materials include but are not limited to those discussed in relation to the knuckles. In a preferred embodiment, the self-lubricating friction reducer is made from a polymer.

Preferably, the bushing 34 incorporates the same oblique angle as the oblique ledge 34. In other words, the bushing 34 is a uniform angled slice from a hollow right circular cylinder. Thus, bushing 34 separates the oblique surfaces (20, 32) while maintaining the angled relationship of the surfaces. The bushing 34 may be made of any suitable polymer that has an appropriate coefficient of friction and that is otherwise compatible with the structure and function of the hinge, gate and fence. Polyethylene, polyester, polypropylene, PTFE and PEEK are representative, and the exact polymer choice can be made by those of skill in this art and without undue experimentation based on factors such as cost, weight, ease of manufacture and industrial purpose. Alternatively, the bushing may be formed of a core material (e.g., metal) that is coated with a polymer. Furthermore, the efficient design of the hinge 10 (shown in FIG. 2) provides great versatility in the choice of polymer. If for some reason the bushing must be changed (for example to a more solvent-resistant bushing), all one must do is lift off the gate portion of the hinge 10 (i.e., the upper knuckles 16) and slide on a different bushing. Known designs of polymer containing gravity gates do not provide this flexibility.

Figure 4:
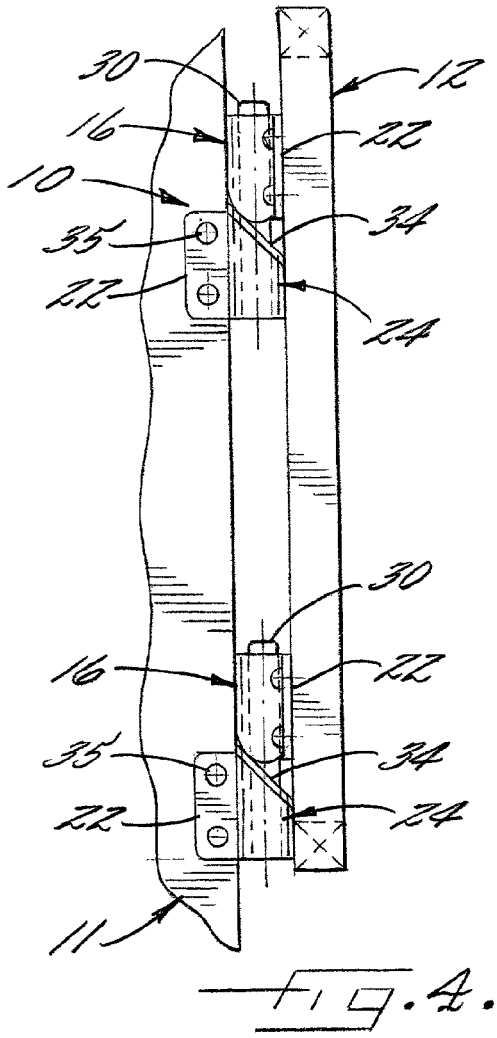
FIG. 4 is an illustration of the action of a rotational force on a hinge according to the invention.

FIGS. 1, 3 and 4 illustrate the operation of one embodiment the hinge 10 according to the invention. In the absence of any rotational force (i.e., at rest) the hinge 10 appears as shown in FIGS. 1 and 3. The oblique surfaces of the knuckles are proximate and parallel to one another and are separated by the bushing 34. Note the relative positions of the screws or bolts 35 that attach the hinge knuckles to the gate 12 and support post 14.

FIG. 4 illustrates the relative positioning of the knuckles (16, 24) upon the application of a rotational force, such as that applied by a person traversing the gate 12. The oblique angle of the junction of the knuckles (16, 24) and bushing 34 causes the upper tubular cylindrical knuckle 16 to rotate upwards upon the application of the rotational force thereby storing potential energy in the hinge 10. Note the relative positions of the screws or bolts 35 in FIG. 4. Upon the release of the rotational force, gravity (and the low friction bushing 34) causes the upper knuckle 16 to "fall" and rotate back to its starting or resting position shown in FIGS. 1 and 3.

Figure 5:
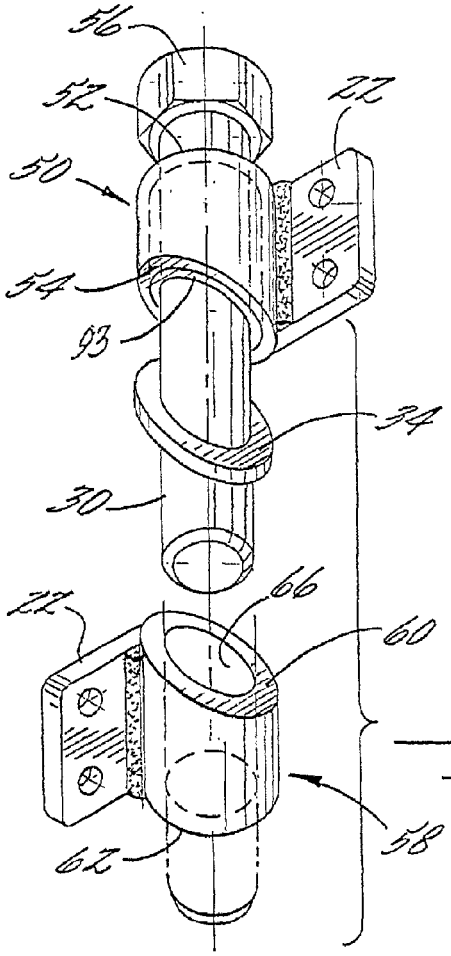
FIG. 5 is an exploded view of one embodiment of the hinge according to the invention.

Another embodiment of the invention is shown in FIG. 5. In this embodiment, a lower knuckle receives a spindle extending from an upper knuckle thereby rotatably engaging the upper knuckle with the lower knuckle. All elements of this embodiment may be made from the materials discussed in conjunction with previous embodiments.

More specifically and in reference to FIG. 5, this embodiment of the invention comprises an upper cylindrical knuckle 50 possessing a first terminating surface 52 and a second terminating surface 54 oblique to the axis of the upper knuckle 50.

A spindle 30 extends from the second terminating surface 54 of the upper knuckle 50. As with previous embodiments, the spindle 30 may be integral to the upper knuckle 50 or separate from the upper knuckle 50. In the latter embodiment, the upper knuckle 50 is preferably tubular and the spindle 30 possesses a cap or nut 56 that is larger than the diameter of the knuckle's tubular opening. The spindle 30 traverses the length of the upper knuckle 50 and the cap 56 prevents the spindle 30 from passing through tubular knuckle 50. The spindle 30 engages with a lower knuckle 58 which is also tubular as shown in FIG. 5. The lower knuckle 58 has a first oblique surface 60 and an opposing second surface 62 similar to the lower knuckles of the previous embodiments. Preferably, the spindle 30 extends to a point beyond the opposing second surface 62 thereby allowing the spindle 30 to remain engaged with the lower knuckle 58 when the spindle 30 rises with the upper knuckle 50 upon the application of a rotational force such as that applied by a person traversing a gate incorporating the hinge.

A self-lubricating friction reducer 34 similar to that described in previous embodiments separates the upper and lower knuckles 50, 58.

Figure 6:
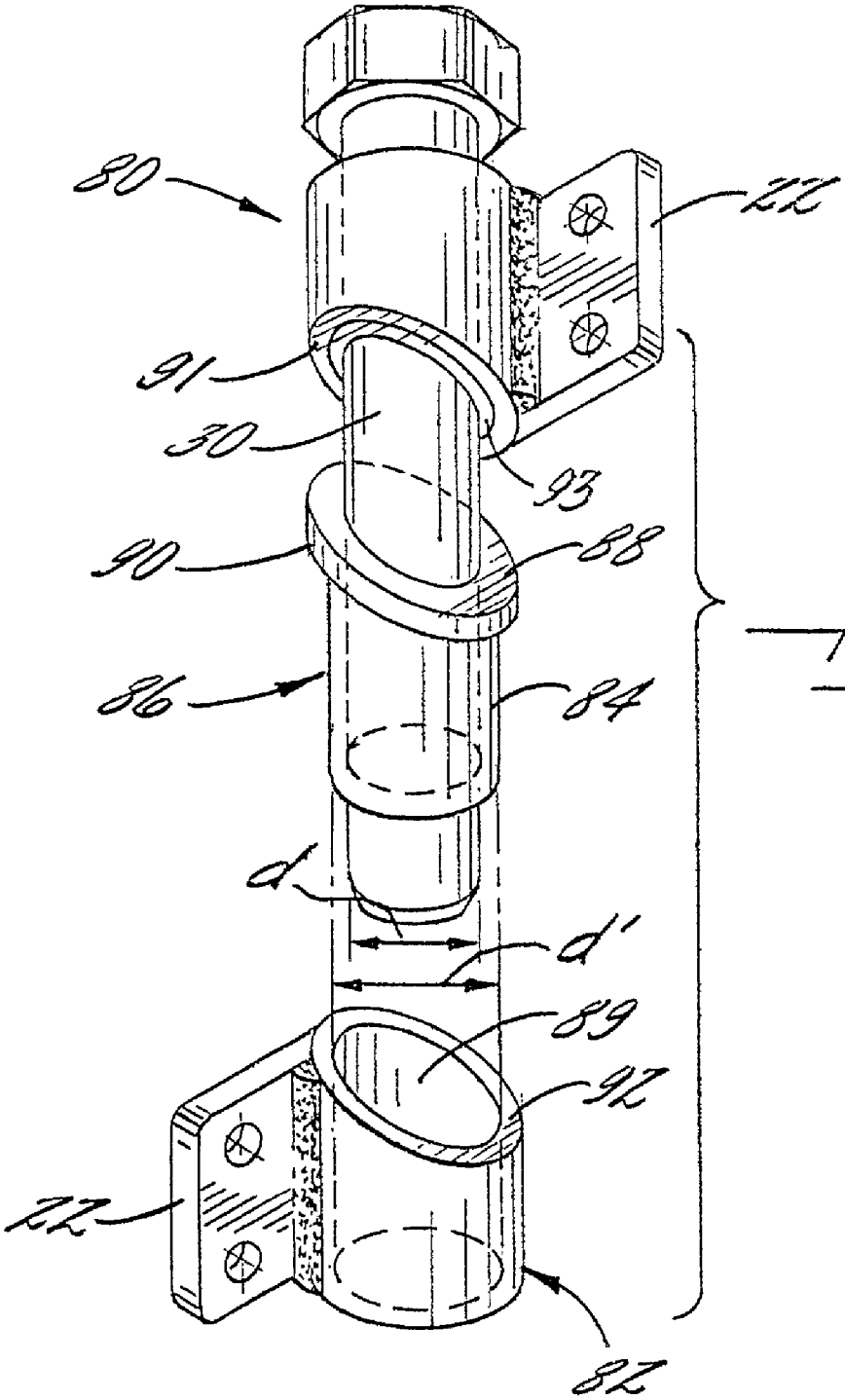
FIG. 6 is an exploded view of one embodiment of the hinge according to the invention.

A further embodiment of the invention is shown in FIG. 6. This embodiment is similar to previous embodiments in that it comprises an upper knuckle 80 and a lower knuckle 82. Each knuckle has an oblique surface (91, 92) that functions similarly to the oblique surfaces of previously described knuckles. A spindle 30 rotatably engages the two knuckles. A self-lubricating friction reducer 86 separates the knuckles from each other and at least one of the knuckles from the spindle 30. FIG. 6 incorporates the basic knuckle design shown in FIG. 5 for ease of explanation. It should be understood, however, that the principles of this embodiment may work in conjunction with any of the previous embodiments.

As shown in FIG. 6, the self-lubricating friction reducer 86 comprises an oblique upper portion (or bushing) 88 and a sleeve 84 that is preferably integral with the oblique upper portion 88. The cylindrical sleeve 84 preferably possess an outer diameter d' that is less than the outer diameter of the oblique upper portion (or bushing) 88 thereby creating a ledge 90 that may rest on the oblique surface 92 of the lower knuckle 82.

One knuckle should possess an opening of a size sufficient to receive both the spindle 30 and the tubular sleeve 84 of the self-lubricating friction reducer 86. In the embodiment shown in FIG. 6, the lower knuckle 82 is tubular as in previous embodiments and possesses an opening 89 having a diameter such that the knuckle 82 may receive a spindle 30 having a diameter (d) and a cylindrical sleeve 84 having an outer diameter of (d').

Those skilled in the art will readily recognize that the self-lubricating friction reducer 86 may be oriented such that the sleeve 84 is received by the upper knuckle 80 in which case the upper knuckle 80 should possess an opening having a diameter sufficient to receive a spindle 30 and the sleeve 84 of the self-lubricating friction reducer 86. Alternatively, the self-lubricating friction reducer 86 could have sleeves 84 extending from both sides of the oblique portion (or bushing) 88. In this instance both knuckles should possess a suitable opening 89 to receive the sleeve 84.

In a further preferred embodiment the sleeve discussed above may be separate from the bushing. Referring again to FIG. 6, the upper knuckle may possess an opening sufficient to receive a separate self-lubricating sleeve that separates the spindle from the upper knuckle. Such a sleeve 93 is shown in each embodiment of the upper knuckle in FIGS. 2, 3, 5 and 6. In yet another alternative, the lower knuckle may be designed to receive a separate sleeve such as that identified by the numeral 93.

As with previous embodiments, the knuckles, self-lubricating friction reducer and sleeves may be made of any suitable material provided the material possesses the requisite structural, chemical and electrical properties. Self-lubricating friction reducers (including the sleeves) made of non-conducting polymers are particularly well suited for applications in which insulating a portion of the overall hinge, gate or fence is desired.

An additional embodiment of the invention is shown in FIG. 1. The embodiment comprises a gravity gate 11 formed of the gravity hinges discussed above. This embodiment incorporates the embodiment of the hinge shown in FIG. 2 but may incorporate any of the other embodiments of the hinge as well. As shown in FIG. 1, the gravity hinge 10 joins a frame member 12 and a static structure 14. The frame member 12 may be a gate or door or other such suitable closure. The static structure 14 maybe a post or wall or any other structure forming part of an opening that is regulated by a gate or door. In preferred embodiments, the gravity gate 11 is used in conjunction with a fence to control the flow of traffic through a secured area. The frame member 12, static structure 14, and fence may be made of metal, wood, polymer or any other suitable material.

The invention has been described in detail, with reference to certain preferred embodiments, in order to enable the reader to practice the invention without undue experimentation. However, a person having ordinary skill in the art will readily recognize that many of the components and parameters may be varied or modified to a certain extent without departing from the scope and spirit of the invention. Furthermore, titles, headings, or the like are provided to enhance the reader's comprehension of this document, and should not be read as limiting the scope of the present invention. Accordingly, only the following claims and reasonable extensions and equivalents define the intellectual property rights to the invention thereof.

That which is claimed is:

1. A low friction gravity hinge consisting essentially of:

an upper cylindrical knuckle having a first terminating surface and an opposing second terminating surface, said second terminating surface being oblique to the axis of said upper knuckle across its entire surface;

a lower cylindrical knuckle having a first terminating surface and an opposing second terminating surface said first terminating surface of said lower cylindrical knuckle being oblique to the axis of said lower knuckle and at the same angle across its entire oblique surface as said second surface of said upper knuckle;

an oblique polymeric bushing between said upper and lower knuckles, said bushing having substantially the same oblique angle as said second terminating surface of said upper knuckle and said first terminating surface of said lower knuckle;

a spindle received by at least one of said knuckles and said bushing for establishing rotating communication between said upper and lower knuckles;

said polymeric bushing having a lower coefficient of friction with respect to said respective oblique surfaces of said upper and lower knuckles than said respective surfaces have for each other and wherein said bushing and said knuckles form a continuous cylinder when said knuckles are in a resting position; and a cylindrical polymeric sleeve within said upper knuckle between said knuckle and said spindle for reducing rotational friction therebetween.

2. A gravity hinge according to claim 1 wherein said upper cylindrical knuckle is tubular and said spindle extends from said first terminating surface of said lower cylindrical knuckle and is received in said upper tubular knuckle.

3. A gravity hinge according to claim 2 wherein said spindle is integral to said lower cylindrical knuckle.

4. A gravity hinge according to claim 2 wherein said lower cylindrical knuckle has a recess for receiving said spindle.

5. A gravity hinge according to claim 1 wherein said lower cylindrical knuckle is tubular and said spindle extends from said second terminating surface of said upper knuckle and is received in said lower tubular knuckle.

6. A gravity hinge according to claim 5 wherein said upper knuckle is tubular and said spindle traverses the length of said upper knuckle and is received in said lower tubular knuckle.

7. A gravity hinge according to claim 1 wherein said bushing and said sleeve form an integral unit.

8. A gravity hinge according to claim 7 in which at least one of said cylindrical knuckles possesses an opening sufficient to receive both said spindle and said sleeve.

9. A gravity hinge according to claim 1 wherein at least one of said knuckles is metallic.

10. A gravity hinge according to claim 1 wherein at least one of said knuckles is ceramic.

11. A gravity hinge according to claim 1 wherein at least one of said knuckles is formed of a polymer.

12. A gravity hinge according to claim 1 further comprising a mounting flange attached to at least one of said knuckles.

13. A gravity gate comprising the gravity hinge according to claim 1.

* * * * *

UNITED STATES PATENT AND TRADEMARK OFFICE

CERTIFICATE OF CORRECTION

PATENT NO. : 7,000,289 B2
DATED : February 21, 2006
INVENTOR(S) : Daniel Pompei Cedrone It is certified that error appears in the above-identified patent and that said Letters Patent is hereby corrected as shown below:

Title page,
Item [75], Inventor, "Pompel" should read -- Pompei --.

Signed and Sealed this

Second Day of May, 2006

JON W. DUDAS
*Director of the United States Patent and Trademark Office*